US005992938A

United States Patent [19]

Jones

[11] Patent Number: 5,992,938

[45] Date of Patent: Nov. 30, 1999

[54] FURNITURE HAVING INTERLOCKING PARTS OF BASIC SHAPES

[76] Inventor: A. David Jones, 343 Causeway Blvd., #C-46, Dunedin, Fla. 34698

[21] Appl. No.: 09/071,334

[22] Filed: May 1, 1998

[51] Int. Cl.[6] ..... A47C 4/00

[52] U.S. Cl. ..... 297/440.13

[58] Field of Search ..... 297/440.13, 440.1

[56] References Cited

U.S. PATENT DOCUMENTS

| | | | |
|---|---|---|---|
| 2,479,086 | 8/1949 | Silverman | 297/440.13 |
| 2,518,955 | 8/1950 | Stelzer | 297/440.13 |
| 4,140,065 | 2/1979 | Chacon | 297/440.13 X |
| 4,225,180 | 9/1980 | Gillis | 297/440.13 X |
| 4,593,950 | 6/1986 | Infanti | 297/440.13 X |
| 4,712,837 | 12/1987 | Swilley | 297/440.13 |

*Primary Examiner*—Peter R. Brown

*Attorney, Agent, or Firm*—Ronald E. Smith; Smith & Hopen, P.A.

[57] ABSTRACT

Items of furniture having interlocking parts formed of basic shapes include a chair formed of a circular back-support part, square legs, and a triangular seat. In a second embodiment, the back-support part of the chair is of octagonal form. In a third embodiment, a companion table has a circular tabletop and legs formed of squares with material-saving cut-outs formed in them. In all embodiments, the parts are slotted to receive slots of equal depth formed in mating parts so that the assembled furniture item is strong and stable. The furniture items have aesthetic appeal and teach children about basic shapes, the art of design, and the art of construction.

3 Claims, 8 Drawing Sheets

FURNITURE HAVING INTERLOCKING PARTS OF BASIC SHAPES

BACKGROUND OF THE INVENTION

1. Field of the invention

This invention relates, generally, to the art of furniture construction. More particularly, it relates to furniture pieces made of interlocking parts where each part is a circle, a square, a triangle, or another basic shape or minor variation thereof.

2. Description of the prior art

Children enjoy learning if the subject matter is attractive and inviting. They dislike studying books for long hours and prefer to learn by working with their hands. For example, they learn more about basic two dimensional shapes such as circles, squares, and triangles when working with tangible objects that are formed in such shapes than when merely observing such shapes in a textbook.

A chair formed of interlocking triangular parts is disclosed in U.S. Pat. No. 4,712,837 to Swilley. Children who take the Swilley chair apart and reassemble it will gain some insight into the nature of triangles, but no such insight will be gained concerning the geometric properties of squares, circles, or other basic shapes.

Furniture items that can be assembled and taken apart by children but which are made of at least one circular part, at least one square part, and at least one triangular part are needed. Such items of furniture would enhance the learning skills of the children who play with them. Moreover, such furniture would have a pleasing appearance.

However, in view of the art considered as a whole at the time the present invention was made, it was not obvious to those of ordinary skill in this art that such furniture items were needed or how such items could be provided.

SUMMARY OF THE INVENTION

The long-standing but heretofore unfulfilled need for an apparatus that overcomes the limitations of the prior art is now met by a new, useful, and nonobvious invention. The invention includes a chair having a flat back-supporting part of predetermined geometric configuration, a flat, triangular seat part, a flat, square, first leg member, and a flat, square, second leg member. The first and second leg members have a common predetermined size.

A pair of parallel, transversely spaced apart slots are formed in the back-supporting part; the slots are in open communication with a peripheral edge of the back-supporting part and have a common predetermined depth.

A slot having closed ends is formed in the back-supporting part as well. The closed-end slot has a longitudinal axis disposed normal to respective longitudinal axes of the transversely spaced apart slots and the closed-end slot is positioned midway between the transversely spaced apart slots.

A pair of parallel, transversely spaced apart slots are formed in the seat part also. Such slots have a common predetermined depth and are respectively in open communication with two sides of the seat part that meet to form an apex of the seat part.

The apex is slideably disposed in the closed-end slot when the chair is in an assembled configuration.

Each leg member of the pair of leg members has suitable slot means formed therein to slideably receive the transversely spaced apart slots formed in the back-supporting part and the transversely spaced apart slots formed in the seat part when the chair is fully assembled.

In a first embodiment of the chair, the predetermined geometrical configuration of the back-supporting part is circular and in a second embodiment thereof, the predetermined geometrical configuration is octagonal, but other predetermined geometrical configurations are within the scope of this invention.

In a third embodiment of the invention, the furniture item is a companion table to the chairs of the first and second embodiments. The novel table has a circular tabletop with a plurality of closed end slots formed therein having longitudinal axes that are radially disposed with respect to one another. A pair of leg members are suitably slotted to interlock with one another and are surmounted by integrally formed tabs that are received within the slots formed in the tabletop to provide a stable and aesthetically-pleasing table.

It is a primary object of this invention to provide furniture items such as chairs and tables that are formed of interlocking parts so that children may disassemble and reassemble them for educational purposes.

Another object is to provide such furniture items that are made of parts having basic two dimensional shapes such as circles, squares, triangles, octagons, or minor variations of such shapes.

Another object is to provide furniture items having an artistic, aesthetic appeal to nurture children's appreciation of art.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
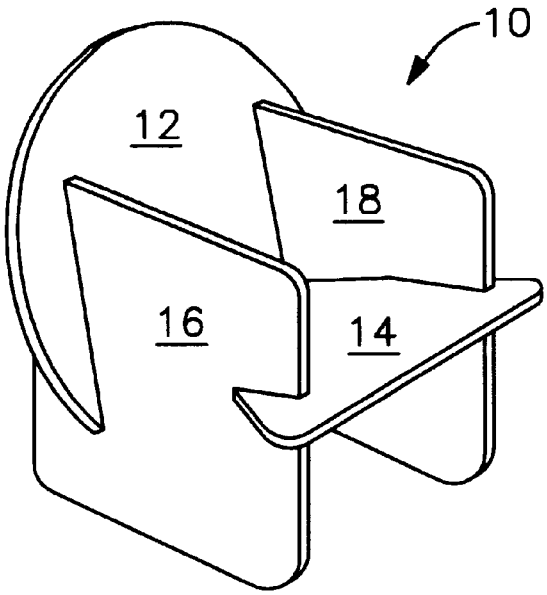
FIG. 1 is a front perspective view of a novel circle-square-triangle chair when in its assembled configuration.

Referring now to FIG. 1, it will there be seen that an exemplary embodiment of the invention is denoted as a whole by the reference numeral 10.

Back-support part 12 of chair 10 has a flat, circular shape as shown and is disposed at a preselected small angle relative to a vertical plane as depicted; the exact angle is immaterial and may be of any comfortable angle.

Seat part 14 has a flat, triangular construction. It is oriented so that its base forms the forward edge of seat 14.

The base means for supporting the novel chair is provided in the form of a pair of parallel, transversely spaced apart leg members or base members denoted 16, 18. Each leg member has a flat, square configuration and is disposed in a vertical plane.

Figure 2:
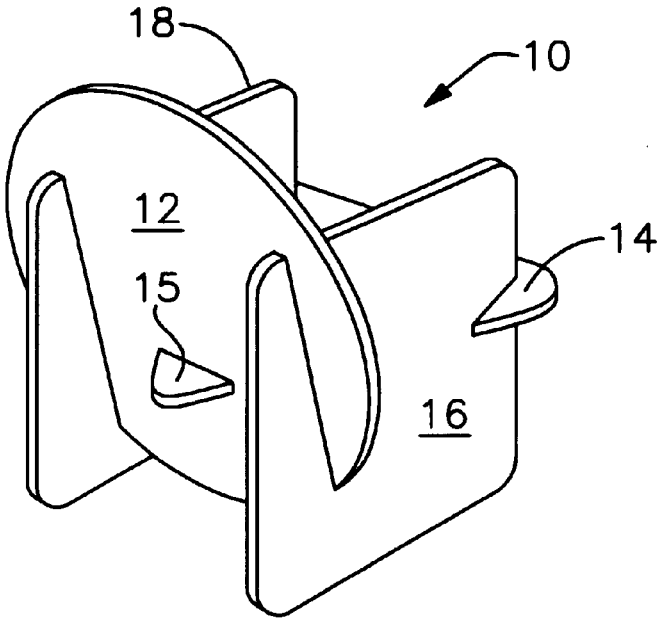
FIG. 2 is a rear perspective view of the chair depicted in FIG. 1.

How the circular, square, and triangular parts interlock with one another is perhaps best understood in connection with FIG. 2. Note that a horizontal slot having closed ends is formed in back-support part 12 and has a length preselected so that it slidingly receives the apex 15 of triangular seat part 14.

The horizontal slot formed in back-support part 12 is denoted 20 in FIG. 3; it is called a closed-end slot to distinguish it from the open-ended slots discussed below.

Figure 3:
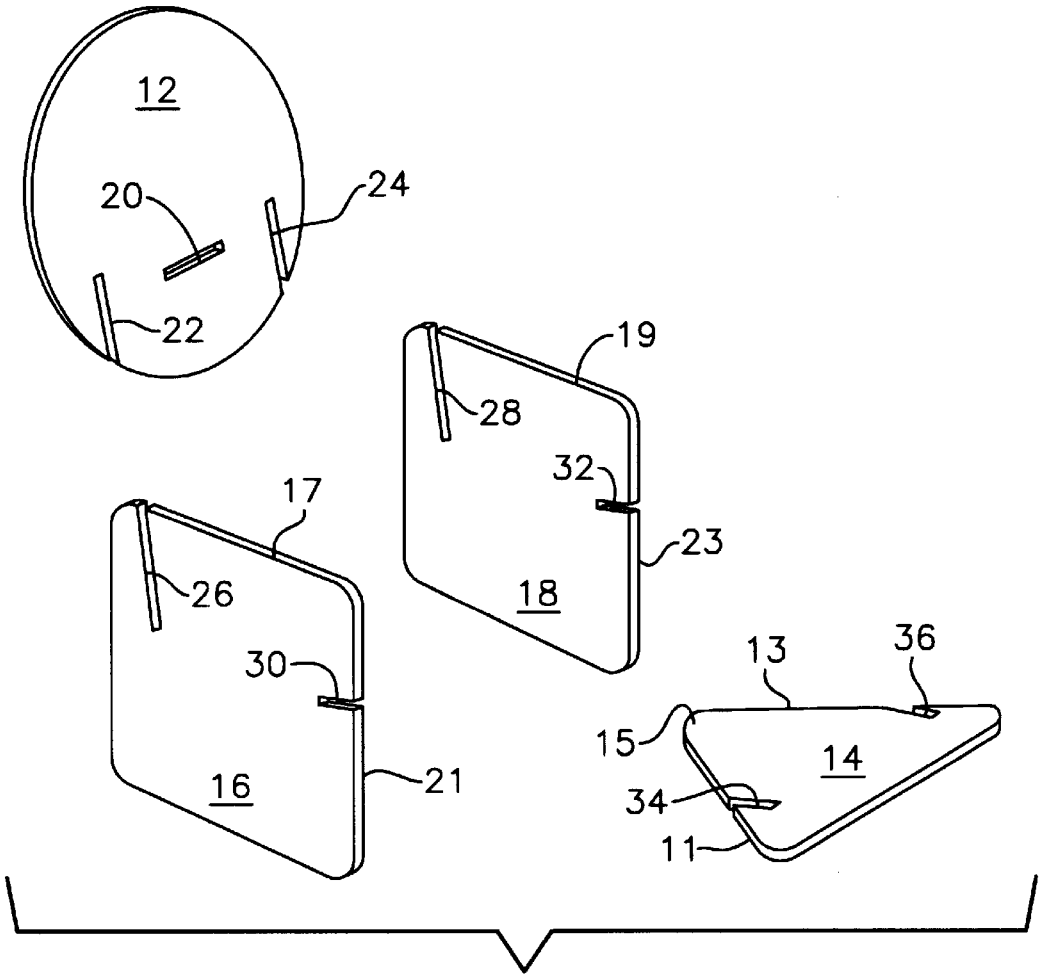
FIG. 3 is an exploded perspective view of the parts that interlock with one another to collectively form the chair of FIG. 1.

The other slots that are formed in the various parts of the novel circle-square-triangle chair are disclosed in FIGS. 3 and 4A–4D, but the specific functions of the respective slots are best understood in connection with FIG. 3.

More particularly, slots 22, 24 of common predetermined depth are formed in back-support part 12 and are in parallel, transversely spaced apart relation to one another. Note that each slot 22, 24 is in open communication with the peripheral edge of circular back-support part 12. Horizontally disposed closed-end slot 20 has a longitudinal axis disposed normal to the respective longitudinal axes of slots 22, 24 and is positioned mid-way between slots 22, 24.

Slots 26, 28 of predetermined depth are respectively formed in leg members 16, 18 and are angled from a vertical plane by a small preselected angle, said angle determining the angle of slope of back-support part 12 when chair 10 is fully assembled. Said slots are in open communication with an upper edge 17, 19, respectively, of leg members 16, 18 and extend a common predetermined depth that is substantially equal to the common depth of slots 22, 24 formed in circular back support part 12.

Slots 30, 32 of common predetermined depth are respectively formed in leg members 16, 18 as well. Each slot 30, 32 is in open communication with a respective leading end 21, 23 of said leg members 16, 18, and is angled a small predetermined angle relative to a horizontal plane. Such angle and the position of closed-end slot 20 predetermine the angle of slope of seat part 14.

A pair of parallel slots, denoted 34, 36, are also formed in opposed sides 11, 13 of triangular seat part 14. Each slot 34, 36 is in respective open communication with opposed sides 11, 13 and said slots have a common predetermined depth substantially equal to the common predetermined depths of slots 30, 32 formed in the leading edges 21, 23 of leg members 16, 18.

When chair 10 is to be assembled, leg members 16, 18 are Positioned in their respective upright, parallel, transversely spaced apart positions so that open-ended slots 26, 28 are generally upwardly opening and so that open-ended slots 30, 32 are facing forwardly, i.e., toward the leading end of the assembly. Back support part 12 is oriented so that open-ended slots 22, 24 formed therein are disposed in downwardly opening configuration. Slots 22, 24 are then slidingly inserted into slots 26, 28, respectively, until the bottom of slot 22 abuts the bottom of slot 26 and the bottom of slot 24 abuts the bottom of slot 28. This firmly interlocks back-support part 12 and leg members 16, 18.

Apex 15 of seat part 14 is then inserted into closed-end slot 20 that is formed in back part 12. At the same time, slot 30 slidingly receives slot 34 and slot 32 slidingly receives slot 36 until the bottom of slot 30 abuts the bottom slot 34 and the bottom of slot 32 abuts the bottom of slot 36. This firmly interlocks seat part 14 to back-support part 12 and to leg members 16, 18. The resulting item of furniture is strong and stable.

Figure 4A:
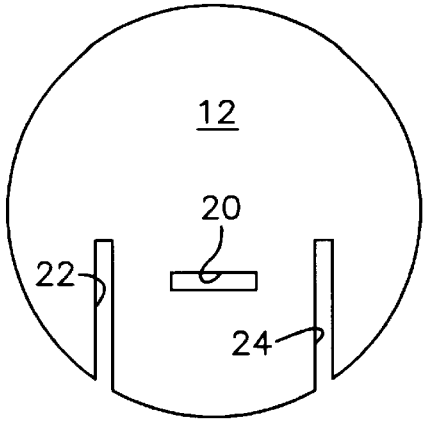
FIG. 4A is a front elevational view of a circular part that form a back-support of said chair.
Figure 4B:
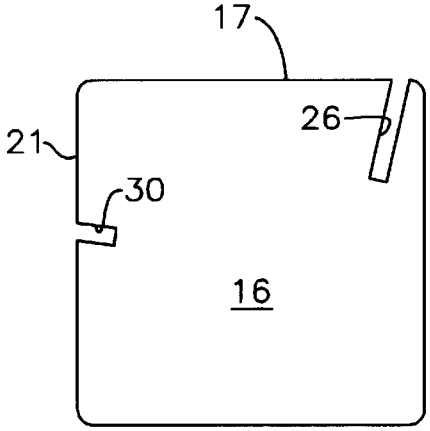
FIG. 4B is a front elevational view of a first square part that forms a first leg or base of said chair.
Figure 4C:
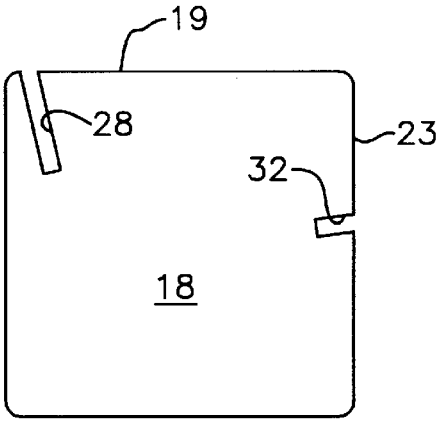
FIG. 4C is a front elevational view of a second square part that forms a second leg or base of said chair.
Figure 4D:
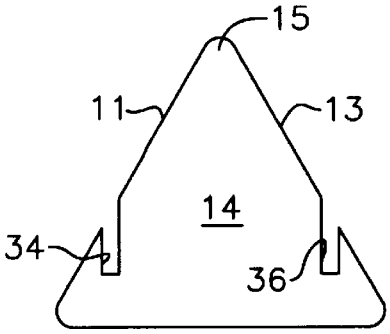
FIG. 4D is a front elevational view of a triangular part that forms a seat part of said chair.

All of the just-mentioned slots are depicted again in FIGS. 4A–4D. The circular shape of back-support part 12 is depicted in FIG. 4A, and the respective square shapes of leg members 16, 18 are depicted in FIGS. 4B and 4C. FIG. 4D indicates that seat part 14 is in the form of an equilateral triangle.

Figure 5:
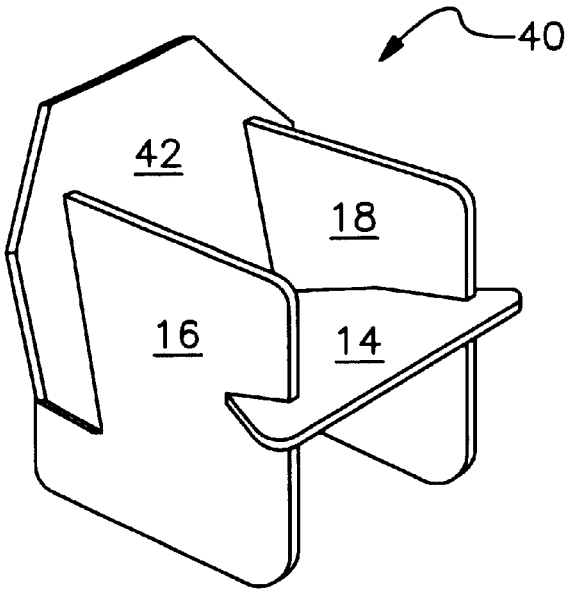
FIG. 5 is a front perspective view of a novel octagon-square-triangle chair when in its assembled configuration.
Figure 6:
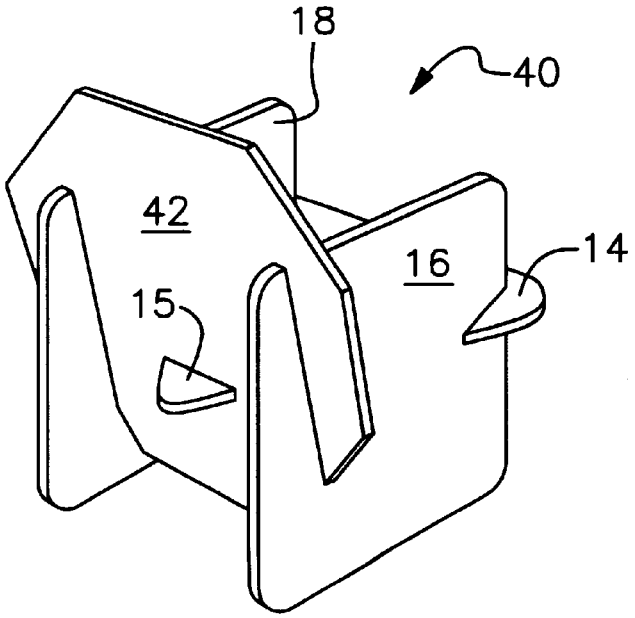
FIG. 6 is a rear perspective view of the chair depicted in FIG. 5.
Figure 7:
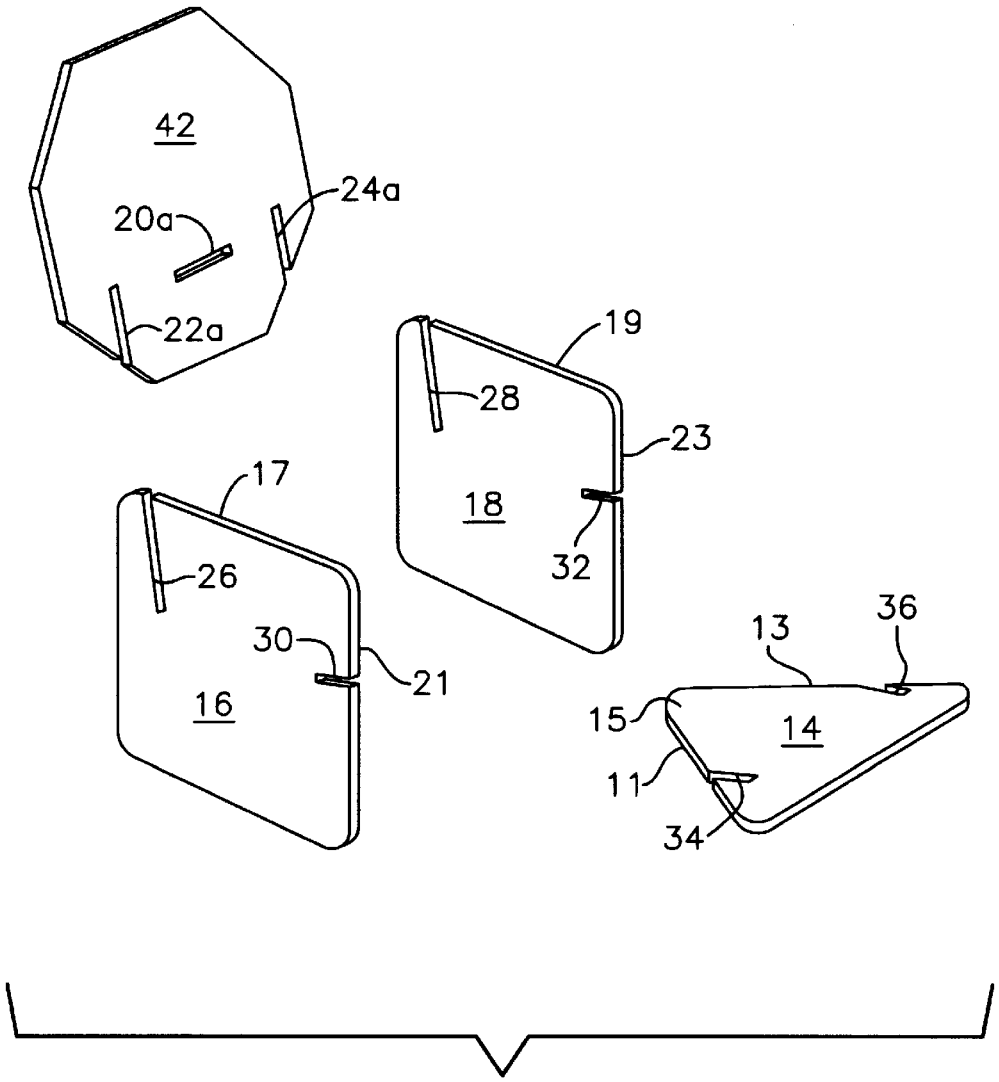
FIG. 7 is an exploded perspective view of the parts that interlock with one another to collectively form the chair of FIG. 5.
Figure 8A:
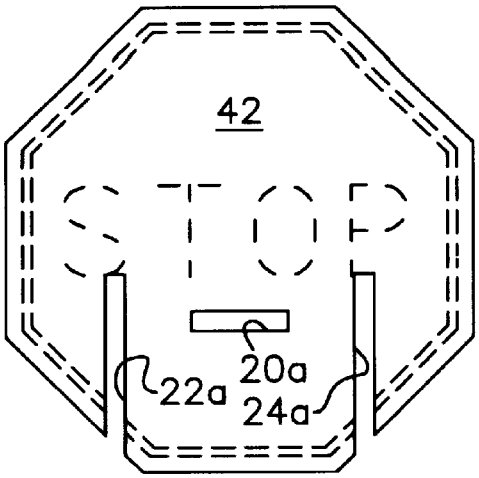
FIG. 8A is a front elevational view of an octagonal part that forms a back-support of the chair of FIG. 5.
Figure 8B:
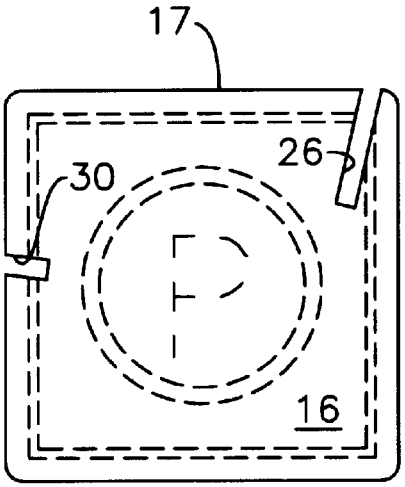
FIG. 8B is a front elevational view of a first square part that forms a first leg or base of the chair of FIG. 5.
Figure 8C:
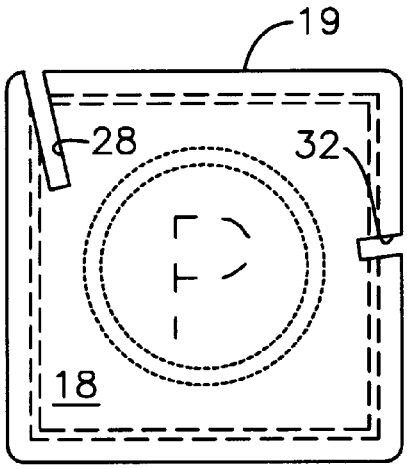
FIG. 8C is a front elevational view of a second square part that forms a second leg or base of the chair of FIG. 5.
Figure 8D:
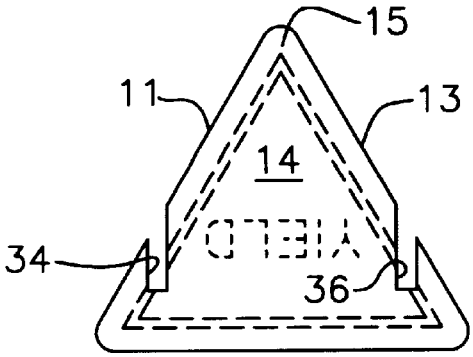
FIG. 8D is a front elevational view of a triangular part that forms a seat part of the chair of FIG. 5.

FIG. 5 depicts a chair 40 having an octagonal back-support part 42. However, seat part 14 and leg members 16, 18 are the same as in the first embodiment of the chair, and all of the parts of chair 40 interlock in the same way as the parts of the first embodiment. Accordingly, as indicated in FIG. 6, apex 15 of triangular seat 14 is slidingly received within a horizontally-extending slot formed in back-support part 42 just as in the first embodiment. In FIG. 7, the just-mentioned slot is denoted 20*a* and the other two slots formed in octagonal back-support part 42 are denoted 22*a*, 24*a*, respectively, to distinguish said slots from their first embodiment counterparts 22, 24. In all other respects, as further indicated in FIGS. 8A–8D, the structural parts of this embodiment are the same as in the first embodiment.

In a commercial embodiment of the octagon-square-triangle chair of FIGS. 5–8D, the word "STOP" is written upon back support member 42 the word "YIELD" is written upon seat part 14, and the letter "P" with a circle around it is written on each leg member 16, 18. This teaches children that octagonal road signs are "STOP" signs and that triangular road signs are "YIELD" signs. An instructor will further advise the children that an encircled "P" on a square road sign indicates a parking area. In this way, children learn about road signs at an early age. Accordingly, a commercial embodiment of chair 40 is to be sold under the trademark "THE TRAFFIC CHAIR."

It should be noted that the parts of chair 10 and chair 40 can be assembled in ways that do not provide a functional chair. Children can use their imagination to construct play "forts" and other structures without regard to the particular assembly described herein. This further enhances the learning opportunities afforded by the novel construction.

Figure 10:
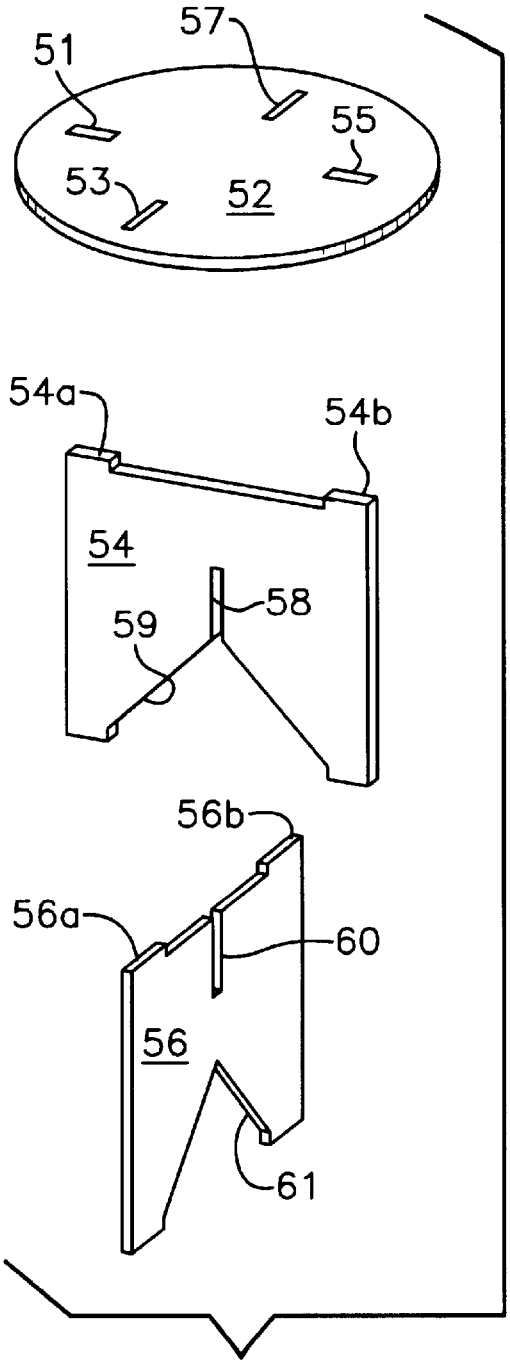
FIG. 10 is an exploded perspective view of the table depicted in FIG. 9.
Figure 9:
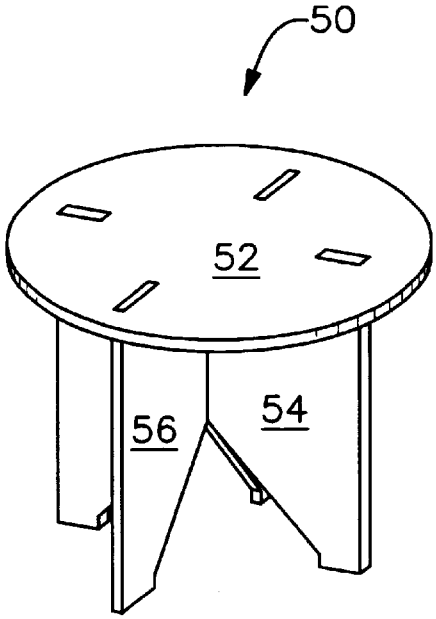
FIG. 9 is a perspective view of a novel table made of interlocking parts when in its assembled configuration.

A companion table to either chair 10 or 40 is depicted in FIG. 9 and is denoted 50 as a whole. It includes a flat circular tabletop 52 supported by upstanding leg members 54 and 56. As best understood in connection with FIG. 10, closed-end slots 51, 53, 55, and 57 are formed in tabletop 52. Said slots have longitudinal axes that are radially disposed with respect to the center of tabletop 52 and are circumferentially and equidistantly spaced with respect to one another.

Leg 54 is generally square in configuration but has an inverted "V" shaped cut-out 59 formed therein. A vertically-extending slot 58 is in open communication with said cut-out 59 at the apex thereof. Tabs 54*a,* 54*b* are integrally formed with leg 54 and project upwardly from the opposite ends of the uppermost edge thereof. Cut-out 59 saves materials and provides an aesthetic effect.

Leg 56 has a construction similar to that of leg 54. Inverted "V"-shaped, materials-saving cut-out 61 is formed in the lower half thereof, but vertically extending slot 60 of predetermined depth is not in open communication with said cut-out 61. Instead, it is in open communication with the uppermost edge of leg 56. Tabs 56*a,* 56*b* project upwardly from opposite ends of said uppermost edge.

To assemble table 50, leg member 56 is positioned in upright relation to a support surface such as a floor, not shown. Leg 54 is positioned thereabove as suggested by the exploded view of FIG. 10 and legs 54 and 56 are interlocked to one another by orienting leg 54 in orthogonal relation to leg 56 and aligning slots 58, 60 with one another. Slots 58 and 60 slideably receive one another until their respective bottom walls abut one another. Slots 51 and 55 of tabletop 52 are then slideably attached to tabs 54*a,* 54*b,* respectively, and slots 53 and 57 are simultaneously attached to tabs 56*a,* 56*b,* respectively. The respective slots and tabs are sized to provide a good friction fit therebetween.

Figure 11:
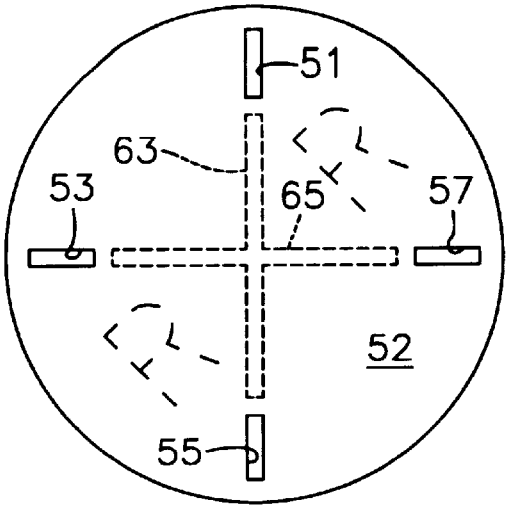
FIG. 11 is a front elevational view of a circular part of said table.
Figure 12A:
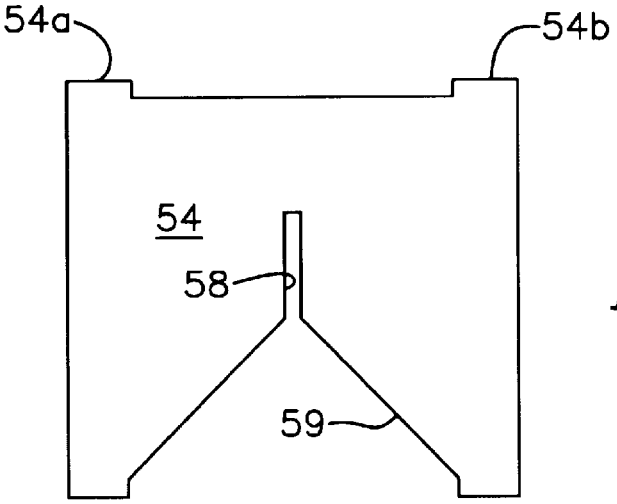
FIG. 12A is a front elevational view of a first leg or base of said table.
Figure 12B:
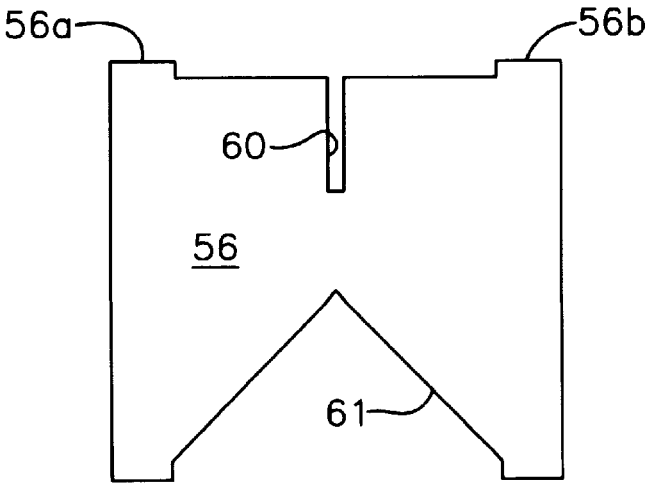
FIG. 12B is a front elevational view of a second leg or base of said table.

The circular shape of tabletop 52 is depicted in FIG. 11, and the square-shaped legs 54 and 56 are depicted in FIGS. 12A and 12B, respectively.

In a commercial embodiment of companion table 50, a diametrically-extending vertical line 63 and a diametrically-extending horizontal line 65 are imprinted or otherwise written on the exposed-to-view surface of tabletop 52 in bisecting, normal relation to one another as indicated in FIG. 11, thereby dividing said table top into four equi-sized quadrants. The letter "R" is written in the southwest and northeast quadrants (as drawn in FIG. 11) of said circular table top 52, and said letters are written at a forty-five degree angle as depicted. In this way, tabletop 52 simulates a railroad crossing sign. This provides a teacher with a further opportunity to teach children about road signs, specifically, that two "R"s written on a circular road sign represent an abbreviation for "railroad crossing." A commercial embodiment of table 50 is to be sold under the trademark "The Traffic Table."

The chairs and table of this invention have artistic appeal and thus teach children that utilitarian articles need not be unattractive. The use of interlocking parts having basic shapes further impresses upon the child the possibilities inherent in the art of design, and will encourage children to make further designs using other shapes as well.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A chair, comprising:

a flat back-supporting part of predetermined geometric configuration;

a flat, triangular seat part;

a flat, square, first leg member;

a flat, square, second leg member;

said first and second leg members having a common predetermined size;

a pair of parallel, transversely spaced apart slots formed in said back-supporting part, said slots being in open communication with a peripheral edge of said back-supporting part and having a common predetermined depth;

a slot having closed ends formed in said back-supporting part;

said slot having closed ends having a longitudinal axis disposed normal to respective longitudinal axes of said transversely spaced apart slots and said slot having closed ends being positioned midway between said transversely spaced apart slots;

a pair of parallel, transversely spaced apart slots formed in said seat part, said slots formed in said seat part having a common predetermined depth, and said slots formed in said seat part being respectively in open communication with two sides of said seat part that meet to form an apex of said seat part;

said apex being slideably disposed in said slot having closed ends when said chair is in an assembled configuration;

each leg member of said pair of leg members having a first pair of parallel, transversely spaced apart slots of of common predetermined depth formed therein in open communication with an upper edge of each of said leg members at a preselected common angle slightly inclined relative to a vertical plane to determine a slope of said back-supporting part and to slideably receive said transversely spaced apart slots formed in said back-supporting part;

each leg member of said pair of leg members further having a second pair of parallel, transversely spaced apart slots of common predetermined depth formed therein in open communication with a leading edge of each of said leg members to slideably receive said pair of slots formed in said seat part;

whereby said back-supporting part, said first and second leg members and said seat part are interconnected to form a chair by said slots which mate with one another when the chair is assembled.

2. The chair of claim 1, wherein said predetermined geometric configuration of said back-supporting part is circular.

3. The chair of claim 1, wherein said predetermined geometric configuration of said back-supporting part is octagonal.

* * * * *